United States Patent [19]

Daley

[11] 4,050,664

[45] Sept. 27, 1977

[54] OBJECT SUPPORT WITH STRAPPING MEANS

[76] Inventor: Thomas G. Daley, 9716 Lanesboro Way, Louisville, Ky. 40222

[21] Appl. No.: 690,435

[22] Filed: May 27, 1976

[51] Int. Cl.[2] ..... B65D 19/00

[52] U.S. Cl. ..... 248/346; 108/55.5; 108/56.3; 108/901; 206/597

[58] Field of Search ..... 108/51.1, 51.3, 55.1, 108/55.3, 55.5, 56.1, 56.3; 248/119 R, 346; 206/320, 386, 597; 214/10.5 R

[56] References Cited

U.S. PATENT DOCUMENTS

| | | | |
|---|---|---|---|
| 1,941,041 | 12/1933 | McKee | 206/386 |
| 2,064,383 | 12/1936 | Porter | 206/386 |
| 2,526,228 | 10/1950 | Hammer | 108/56.3 X |
| 2,611,569 | 9/1952 | Coleman et al. | 108/56.3 X |
| 2,630,214 | 3/1953 | Reed | 206/386 X |
| 2,997,266 | 8/1961 | Munroe | 108/51.3 |
| 3,567,068 | 3/1971 | Carfizzi | 248/346 X |
| 3,626,860 | 12/1971 | Blatt | 108/51.3 |
| 3,921,279 | 11/1975 | Daley | 108/901 X |

FOREIGN PATENT DOCUMENTS

| | | | |
|---|---|---|---|
| 1,938,662 | 4/1971 | Germany | 108/56.3 |
| 1,144,715 | 3/1969 | United Kingdom | 108/51.3 |

*Primary Examiner*—Roy D. Frazier
*Assistant Examiner*—William E. Lyddane

[57] ABSTRACT

An apparatus for supporting and securing objects thereon, the support being a base member with means on the top side thereof for receiving an object and strapping means attached to the bottom thereof disposed to extend around the object and secure it thereto. The base member is comprised of a conduit member having disposed at preselected portiions therein resilient foam materials which maintains the base member in a preselected configuration and supports and object thereon.

8 Claims, 2 Drawing Figures

OBJECT SUPPORT WITH STRAPPING MEANS

BACKGROUND OF THE INVENTION

Figure 1:
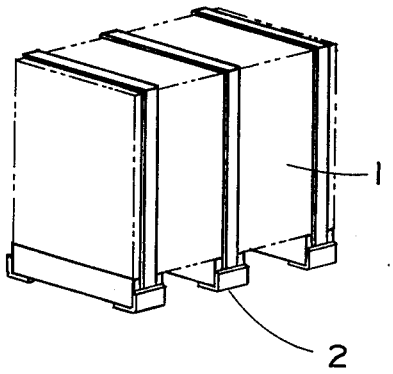

This invention relates to an apparatus for supporting an object thereon and more particularly relates to a support apparatus for an object with means to secure an object to a support.

In the preparation of hard goods for shipment, such as major appliances, it is an accepted practice to mount these goods onto runners or skids, the runners or skids absorbing shock and preventing damage to the goods during shipment. After the goods have reached their destination the support runners are usually removed from the hard goods and discarded. Presently, the most common support runners utilized in the shipment of major appliances are those comprised of a pair of strips of wood with shock absorbing material, such as a resilient foam material, sandwiched therebetween, the runners being attached in parallel along opposing edges of the appliance. However, with the increasing cost of wood in the manufacture of these runners, it has been necessary to find a more economical means of support for these goods, as well as one with means thereon to secure appliances thereto during shipment. Furthermore, it has become necessary to find runners that will withstand shock and prevent damage in shipment from the manufacturing plant to the ultimate point of use.

SUMMARY OF THE INVENTION

In the present invention, it is recognized that it is desirable to provide an apparatus for supporting and securing an object for shipment which is economical to manufacture. It is further recognized that it is desirable to provide an apparatus for supporting and securing an object for shipment which is equal or superior to the supports presently available commercially.

The present invention advantageously provides a straightforward arrangement for a shipping support with securing means attached thereto for securing an object thereon. The present invention further provides for a support for an object for shipping which is economical to manufacture in comparison with presently available shipping supports and hard goods and yet has improved supporting and securing characteristics.

Various other features of the present invention will become obvious to those skilled in the art upon reading the disclosure set forth hereinafter.

More particularly, the present invention provides a support for an object comprising: at least one conduit base member with means on the top side thereof for receiving an object thereon with securing means attached to the bottom side thereof; said securing means including means to secure said object to said base member; said conduit member having disposed at preselected portions therein resilient foam material, said resilient foam material being affixed to the inner surface of said conduit member and serving to maintain said conduit member in a preselected configuration when said object is mounted onto said conduit member.

It is to be understood that the description of the examples of the present invention given hereinafter are not by way of limitation. Various modifications within the scope of the present invention will occur to those skilled in the art upon reading the disclosure set forth hereinafter.

Figure 2:
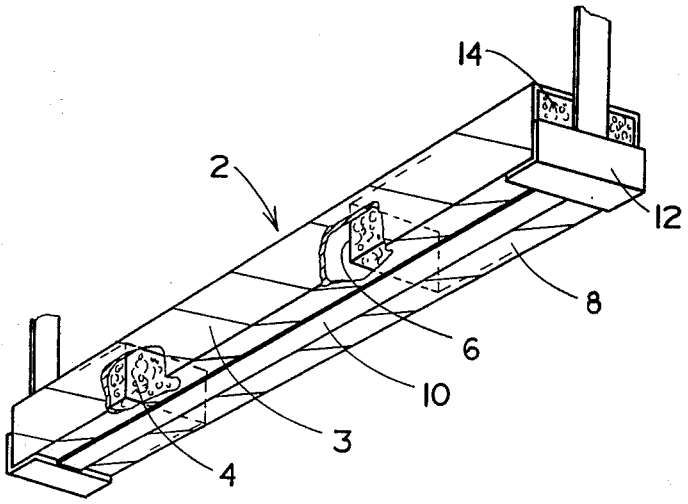

Referring to the drawings:

FIG. 1 is a perspective view illustrating a preferred object support of the present invention with an object mounted and secured thereon; and, FIG. 2 is a perspective view, partially cut-away, of an object support member of the present invention.

In FIG. 1 of the drawing an object 1 is shown mounted onto a plurality of supports 2 of the present invention.

In FIG. 2, one of the supports 2 shown in FIG. 1 is illustrated with selected portions cut away. The support 2 of the present invention includes a hollow member 3 which is exemplified as being a convolute wound 50 pound semi-chemical recycled kraft container board of rectangular configuration. The rectangular shaped member 3 can also be spiral wound. At substantially each end of the support 2 is a preselected resilient foam portion identified by numerals 4 and 6, one preferred resilient foam being a polyurethane. The resilient foam portions are provided to support hard goods and maintain the spiral member in a preselected geometric configuration with the object 1 being mounted thereto. The amount of resilient foam material which is included within the hollow member depends upon the physical characteristics of the foam and the load to which it will be subjected.

Generally, resilient foam portions 4 and 6 are disposed only at each end of the support member 2. However, in certain instances where the object to be mounted thereto is long, heavy, or protection against a relatively large degree of shock is necessary, additional preselected portions of the member 3 may include the resilient foam therein.

Resilient foam portions 4 and 6 may be formed of any suitable resilient foamed material. A polyurethane foam is a preferred material since it has been found that it has the most desirable characteristics of foam materials presently available on the market. It is to be understood, of course, that other resilient foamed materials may be entirely suitable for use in the support depending upon the sensitivity of the object to be carried. Thus, for instance, foamed polyethylene, expanded polystyrene, and foam rubber may also be used.

Attached to the bottom surface 8 of the member 3 is a strapping member 10, strapping member 10 being a thin elongated strip of flexible material, generally, plastic or metal. The strapping member 10 is fixedly attached to the surface 8, generally by adhesively securing a strap holding member 12 to the surface 8 with the member 10 disposed therebetween. The strap holding member 12 utilized in my invention is usually a reinforced or laminated fiberboard. However, other strap holding members such as, for example, masonite, polyvinyl chloride, polypropylene, as well as other plastic materials which will hold the strapping member 10 in place when properly secured may also be utilized.

In securing the strap holding member 12 to the surface 8, this is generally accomplished by utilizing a fast setting adhesive, those referred to as "hot melts", "hot melts" being the term applied to those thermoplastic adhesives that flow at elevated temperatures, such as 350° F, but upon chilling harden and become tacky. These include, for example, hide glues, bone glues, polyethylene base binders, polypropylene base binders, ethylene vinyl acetate binders, and the like. Also, other adhesives, as well as staples or other mechanical means, and the like may also be used without departing from the scope and spirit of my invention.

The strap holding member 12 extends along the surface 8 a preselected distance and upwardly over the open end 14 of the member 3. The preselected distance along the surface 8 is generally just sufficient in combination with the selected adhesive to hold the strapping member 10 thereto under a predetermined stress. The upwardly extending portion of the member 12 generally covers from about 30 to 70 percent of the open end 14, the upwardly extending portion acting as a dam during the set of the foam portions 4 and 6.

It has been found that by attaching the strapping member 10 to the bottom of the member 3 that when forces from different directions are applied to the object 1 and the support 2, chances of separating the object 1 from the support 2 are minimized. It has been found that when a strapping member is attached to the top of a conduit support member or when the strapping member is passed through the opening in the conduit member, upon applying forces from different directions to the object 1 and the support 2, the strapping member pulls away from the support. Thus, by attaching the strapping member 10 to the bottom surface 8, this problem is alleviated.

In the production of the supports of my invention, I generally pre-heat the inner surface of the hollow member 3 with pre-heated compressed air, whereby the temperature of the inner surface of member 3 is brought to a temperature sufficient to start the reaction of a foam mix. The foam mix is then added to the preselected portions 4 and 6, usually around the pre-heated inner surface, allowing the mix to foam inwardly. As soon as the mix is in, strapping member 10 is aligned substantially along the bottom surface 8 and a hot melt adhesive is added at each end of the surface 8 completely covering a preselected area coinciding with the area to be covered by the strap holding member 12. Hot melt is also added along the edges defining the opening 14, the upwardly extending portion being determined by the area to be enclosed by the strap holding member 12. As soon as the adhesive is applied, the strap member 10 and the strap holding member 12 are attached thereto. After the strap holding member 12 has been attached, the foaming reaction continues with the strap holding member 12 defining a dam for the set of the foam.

It is realized that the strapping member 10 and the strap holding member 12 may be attached to the member 3 prior to the addition of the foam reactants. In my preferred method, however, the foaming mix is added prior to the attaching of the strapping and strap holding members 10 and 12.

It will be realized that various changes may be made to the specific embodiment shown and described without departing from the principals of my invention.

What is claimed is:

1. A support for an object comprising: at least one conduit base member with means on the top side thereof for receiving an object thereon with securing means attached to the bottom side thereof, said securing means including means to secure said object to said base member, said securing means including a strap holding member adhesively secured to a bottom surface of said conduit member with a strapping member sandwiched therebetween, said strap holding member extending upwardly a preselected distance over a portion of at least one end of said conduit member; said conduit member having disposed at preselected portions therein a resilient foam material, said resilient foam material being affixed to the inner surface of said conduit member and serving to maintain said conduit member in a preselected configuration when said object is mounted onto said conduit member.

2. The support of claim 1 wherein the cross-sectional configuration of said resilient foam material is substantially the same as the cross-sectional configuration of the inner surface of said conduit member.

3. The support of claim 1 wherein said resilient foam material is a polyurethane foam.

4. The support of claim 1 wherein said strapping member being an elongated strip of flexible material.

5. The support of claim 4 wherein the strapping member is a thin elongated strip of metal.

6. The support of claim 4 wherein the strapping member is a thin elongated strip of plastic.

7. The support of claim 1 wherein said conduit member is paperboard.

8. The support of claim 1 including two conduit base members in parallel, each of said members being positioned along an outer edge of said object to be supported, said conduit base members being of substantially the same length as the edge of said object to which they are attached.

* * * * *